US011200841B2

(12) United States Patent
Kim et al.

(10) Patent No.: US 11,200,841 B2
(45) Date of Patent: Dec. 14, 2021

(54) DRIVER OF DISPLAY DEVICE

(71) Applicant: Silicon Works Co., Ltd., Daejeon (KR)

(72) Inventors: Dong Ju Kim, Daejeon (KR); Won Kim, Daejeon (KR); Jeong Hoon Choi, Daejeon (KR); Jung Bae Yun, Daejeon (KR); Jeung Hie Choi, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 0 days.

(21) Appl. No.: 16/762,722

(22) PCT Filed: Nov. 7, 2018

(86) PCT No.: PCT/KR2018/013449
§ 371 (c)(1),
(2) Date: May 8, 2020

(87) PCT Pub. No.: WO2019/093751
PCT Pub. Date: May 16, 2019

(65) Prior Publication Data

US 2020/0273403 A1 Aug. 27, 2020

(30) Foreign Application Priority Data

Nov. 9, 2017 (KR) ..... 10-2017-0148754

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2320/0233* (2013.01); *G09G 2320/0295* (2013.01); *G09G 2320/043* (2013.01)

(58) Field of Classification Search
None
See application file for complete search history.

(56) References Cited

U.S. PATENT DOCUMENTS 8,059,020 B2 * 11/2011 Schatzberger ..... H03M 1/186 341/138
2014/0368415 A1 * 12/2014 Kim ..... G09G 3/3208 345/77
2015/0379937 A1 * 12/2015 Kim ..... G09G 3/3291 345/691
2017/0294159 A1 * 10/2017 Lee ..... H01L 27/3248

FOREIGN PATENT DOCUMENTS

KR 2012-0027975 A 3/2012
KR 10-1493226 B1 2/2015
KR 10-1529005 B1 6/2015
KR 2016-0001822 A 5/2016
KR 2016-0087058 A 7/2016

OTHER PUBLICATIONS

Cao et al, A Study on Voltage Reference Buffers for Low Voltage Switched Capacitor Data Converters, IEEE, 2006, pp. 502-506 (Year: 2006).*

* cited by examiner

*Primary Examiner* — Dorothy Harris
(74) *Attorney, Agent, or Firm* — Polsinelli PC

(57) ABSTRACT

A driver of a display device is disclosed. In order to solve a signal processing error likely to occur in an analog-digital converter which processes a pixel sensing signal provided from a pixel of a display panel, the pixel sensing signal is converted, or an input range of the analog-digital converter is corrected.

10 Claims, 4 Drawing Sheets

DRIVER OF DISPLAY DEVICE

TECHNICAL FIELD

The disclosure relates to a driver of a display device, and more particularly, to a driver of a display device capable of solving a signal processing error likely to occur in an analog-digital converter which processes a pixel sensing signal provided from a pixel of a display panel.

BACKGROUND ART

A liquid crystal display panel (LCD panel) and an organic light emitting diode panel (OLED panel) are widely used in a display device for realizing a flat panel display.

The display device includes a timing controller, a source driver, a gate driver, a sensing line control unit, and a display panel.

The timing controller provides display data to the source driver. The source driver generates a source signal corresponding to the data provided from the timing controller, outputs the source signal to the display panel, and receives a pixel sensing signal outputted from a pixel of the display panel. The gate driver drives pixels of the display panel in line unit. The sensing line control unit controls the pixels of the display panel to output pixel sensing signals. The display panel includes a plurality of pixels, and each pixel is driven in correspondence to a gate signal of the gate driver and data of the source driver.

In the display device configured as mentioned above, the brightness of each of the pixels of the display panel is determined by the amount of current flowing through a light emitting diode included in the pixel. The pixel includes a driving transistor which supplies current to the light emitting diode.

In order to control the pixel to emit light uniformly or emit light at a desired luminance, the analysis of characteristics of the driving transistor is required. In order to analyze the characteristics of the driving transistor of the pixel, the pixel sensing signal generated under the control of the sensing line control unit is used. That is to say, the characteristics such as the threshold voltage and mobility of the driving transistor may be determined by the pixel sensing signal.

The pixel sensing signal of the pixel of the display panel is provided to the source driver. The source driver converts the pixel sensing signal into a digital signal by an analog-digital converter therein, and provides the digital signal to the timing controller.

A driving voltage of the pixel of the display panel and a driving voltage of the analog-digital converter of the source driver are power sources which have different levels.

The driving voltage of the analog-digital converter may be defined as VCC, and is set to, for example, a level of 1.6V to 2V. An input range of the analog-digital converter is determined by a high level reference voltage VT and a low level reference voltage VB. Both the reference voltage VT and the reference voltage VB are voltages having levels lower than the driving voltage VCC.

A driving voltage of the pixel may be defined as PVDD, and is set to, for example, a level of 18V to 24V. Therefore, the pixel sensing signal of the pixel has a sensing range of the level of 18V to 24V.

Thus, the input range within which the analog-digital converter may receive the pixel sensing signal is smaller than the sensing range of the pixel sensing signal.

Therefore, the analog-digital converter may receive the pixel sensing signal which is out of the input range.

In detail, it is assumed that an input range of a 10-bit analog-digital converter is 0.4V to 1.4V.

First, the pixel sensing signal may be generated in the range of 3V to 4V in the sensing range of the pixel having the level of 18V to 24V. A range in which the pixel sensing signal is generated may be defined as a signal range, and the signal range is included in the sensing range. In this case, the analog-digital converter is maintained to output a digital signal corresponding to 1.4V being a maximum value of the input range, with respect to the entire signal range of the pixel sensing signal higher than the maximum value of the input range. In other words, data for all voltage regions of the pixel sensing signal are lost.

Further, the pixel sensing signal may be generated in the signal range of 0.4V to 3.4V in the sensing range of the pixel having the level of 18V to 24V. In this case, the analog-digital converter may perform a converting operation on a partial signal range of 0.4V to 1.4V of the pixel sensing signal, which corresponds to the input range. However, the analog-digital converter is maintained to output a digital signal corresponding to 1.4V being the maximum value of the input range, with respect to the remaining signal range of 1.4V to 3.4V of the pixel sensing signal higher than the maximum value of the input range. Namely, data for a partial signal range of the pixel sensing signal which exceeds the input range of the analog-digital converter is lost.

As described above, in the case where a partial or entire signal range of the pixel sensing signal is out of the input range of the analog-digital converter, a difficulty exists in a normal analog-digital converting operation of the analog-digital converter.

In addition, the analog-digital converter and a reference voltage generator which provides the reference voltages VT and VB may have an offset or a gain change due to a process deviation.

Therefore, the reference voltage generator may provide the reference voltages VT and VB which have a deviation due to the offset. In this case, a change in the input range of the analog-digital converter is caused.

The analog-digital converter may receive the reference voltages VT and VB which have a deviation due to the gain change or the offset. Even in this case, a change in the input range of the analog-digital converter is caused.

In the case where the difference between the reference voltage VT and the reference voltage VB increases, as the input range of the analog-digital converter increases, a gain decreases. On the contrary, in the case where the difference between the reference voltage VT and the reference voltage VB decreases, as the input range of the analog-digital converter decreases, a gain increases.

Hence, the analog-digital converter has a difficulty in accurately performing analog-digital conversion on the pixel sensing signal, due to the input range having a deviation.

DISCLOSURE

Technical Problem

Various embodiments are directed to a driver of a display device capable of performing normal analog-digital conversion on a pixel sensing signal of a display panel by converting a signal range of the pixel sensing signal in the case where a partial or entire signal range of the pixel sensing signal is out of an input range of an analog-digital converter.

Also, various embodiments are directed to a driver of a display device capable of accurately performing analog-digital conversion on a pixel sensing signal by compensating for a change in an input range of an analog-digital converter due to a process deviation.

Technical Solution

In an embodiment, a driver of a display device may include: an analog-digital converter configured to receive a first pixel sensing signal within a preset input range, and perform analog-digital conversion on the first pixel sensing signal; and an input signal converter configured to receive a second pixel sensing signal from a pixel of a display panel, convert the second pixel sensing signal by using a control signal such that a signal range of the second pixel sensing signal falls within the input range, and output the first pixel sensing signal obtained as the second pixel sensing signal is converted, to the analog-digital converter.

In an embodiment, a driver of a display device may include: an analog-digital converter configured to receive a pixel sensing signal within an input range that is defined by a first reference voltage and a second reference voltage, and perform analog-digital conversion on the pixel sensing signal; and an input range converter configured to provide the first reference voltage and the second reference voltage to the analog-digital converter, and convert the input range by changing at least one of the first reference voltage and the second reference voltage in response to a control signal for compensating for a deviation of the input range.

In an embodiment, a driver of a display device may include: an analog-digital converter configured to receive a first pixel sensing signal within an input range that is defined by a first reference voltage and a second reference voltage, and perform analog-digital conversion on the first pixel sensing signal; an input signal converter configured to receive a second pixel sensing signal from a pixel of a display panel, convert the second pixel sensing signal by using a control signal such that a signal range of the second pixel sensing signal falls within the input range, and output the first pixel sensing signal obtained as the second pixel sensing signal is converted, to the analog-digital converter; and an input range converter configured to provide the first reference voltage and the second reference voltage, and convert the input range by changing at least one of the first reference voltage and the second reference voltage in response to a second control signal for compensating for a deviation of the input range, wherein the analog-digital converter receives the second pixel sensing signal whose signal range is converted, within the input range whose deviation is compensated for by the second control signal.

Advantageous Effects

According to the embodiments of the disclosure, the driver of a display device converts a signal range of a pixel sensing signal of a display panel in a shift or scale conversion scheme in the case where a partial or entire signal range of the pixel sensing signal is out of an input range of an analog-digital converter. Accordingly, an analog-digital converter which is configured in the driver of a display device may perform normal analog-digital conversion on the pixel sensing signal generated in the environment of a driving voltage different from its own driving voltage.

Also, according to the embodiments of the disclosure, the driver of a display device may compensate for a change in an input range of an analog-digital converter due to a deviation between reference voltages. Accordingly, the analog-digital converter which is configured in the driver of a display device may maintain a normal input range to receive a pixel sensing signal, and may accurately perform analog-digital conversion on the analog pixel sensing signal.

MODE FOR DISCLOSURE

Figure 1:
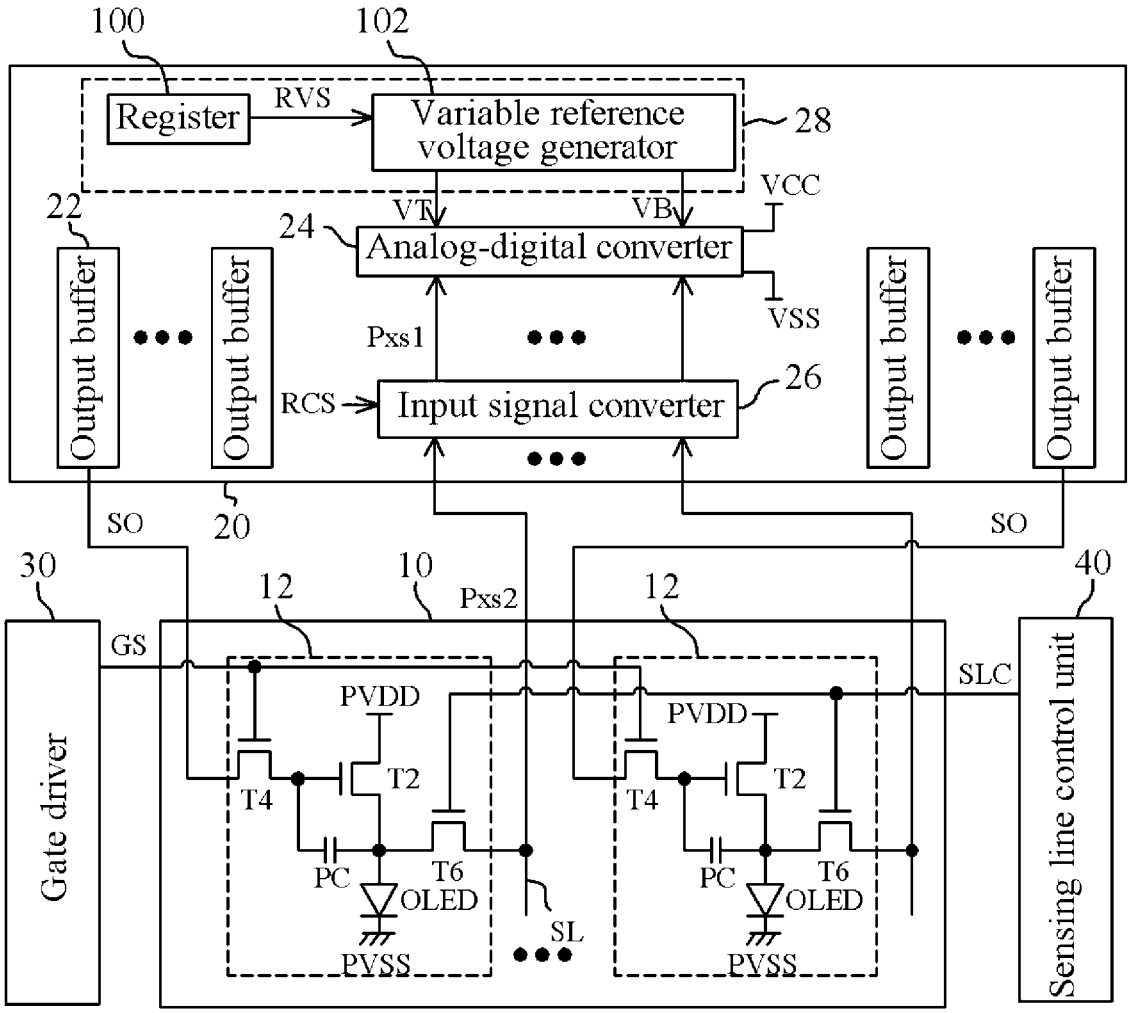
FIG. 1 is a circuit diagram illustrating a representation of an example of a display device including a driver realized as an embodiment of the disclosure.

Hereinafter, embodiments of the disclosure will be described in detail with reference to the accompanying drawings. The terms used herein and in the claims shall not be construed as being limited to general or dictionary meanings and shall be interpreted as the meanings and concepts corresponding to technical aspects of the disclosure.

Embodiments described herein and configurations illustrated in the drawings are preferred embodiments of the disclosure, but do not represent all of the technical features of the disclosure. Thus, there may be various equivalents and modifications that can be made thereto at the time of filing the present application.

A driver of a display device in accordance with embodiments of the disclosure may be defined as one which receives a pixel sensing signal of a display panel and outputs a digital signal corresponding to the pixel sensing signal by using an analog-digital converter therein. It is exemplified that the driver is realized as a source driver in accordance with the embodiments of the disclosure. However, the disclosure is not limited thereto, and may be interpreted by being extended to all drivers having a function of receiving a pixel sensing signal. The driver may be mounted as an integrated circuit.

As illustrated in FIG. 1, a display device includes a display panel 10, a source driver 20, a gate driver 30, and a sensing line control unit 40. The source driver 20 may be understood as a driver which is embodied by the disclosure.

The display panel 10 includes a plurality of pixels 12, and each pixel 12 includes a light emitting diode OLED, a driving transistor T2, a switching transistor T4, a capacitor PC, and a sensing transistor T6.

The pixel 12 is driven by a source signal SO of the source driver 20 and a gate signal GS of the gate driver 30, and provides a pixel sensing signal Pxs2 for the driving transistor T2, through the sensing transistor T6.

In detail, the switching transistor T4 is configured to be driven by the gate signal GS applied to the gate thereof and apply the source signal SO, provided from the source driver 20, to the gate of the driving transistor T2 when being turned on. The driving transistor T2 is turned on in response to the source signal SO applied to the gate thereof, and controls an amount of current flowing therethrough depending on a level of the source signal SO.

In the case where the driving transistor T2 is turned on, current by a driving voltage PVDD flows to the light emitting diode OLED, and an amount of current flowing through the light emitting diode OLED is determined by the source signal SO.

The light emitting diode OLED is configured to be applied with the driving voltage PVDD and a ground voltage PVSS at both ends thereof, respectively, when the driving transistor T2 is turned on, and emits light to brightness corresponding to the amount of current.

The capacitor PC is configured between the gate and the drain of the driving transistor T2. The capacitor PC is charged with the source signal SO to exert an influence on the operation of the driving transistor T2.

The pixel 12 is configured to output the pixel sensing signal Pxs2 for analyzing the characteristics of the driving transistor T2, in response to a sensing control signal SLC of the sensing line control unit 40.

The analysis of the characteristics of the driving transistor T2 is necessary to control the pixel 12 to emit light uniformly or emit light at a desired luminance. By the pixel sensing signal Pxs2, characteristics such as the threshold voltage and mobility of the driving transistor T2 may be determined.

To this end, the sensing transistor T6 is configured between a node between the driving transistor T2 and the light emitting diode OLED and a pixel sensing line SL. The sensing transistor T6 is switched depending on a state of the sensing control signal SLC of the sensing line control unit 40, applied to the gate thereof, and, when being turned on, outputs a signal corresponding to current flowing from the driving transistor T2 to the light emitting diode OLED, as the pixel sensing signal Pxs2. The pixel sensing signal Pxs2 may be outputted in the form of a voltage or current depending on a sensing method. An embodiment of the disclosure may illustrate that the pixel sensing signal Pxs2 is outputted as a voltage.

An image of one frame which is formed by the pixels 12 of the display panel 10 includes a plurality of horizontal lines. The gate driver 30 may be configured to sequentially output gate signals GS to the respective horizontal lines with a cycle of one frame unit. Therefore, switching transistors T4 of pixels 12 of the same horizontal line may be simultaneously turned on, and the pixels 12 of the same horizontal line may simultaneously emit light in response to respective source signals SO.

The gate driver 30 is configured to provide the gate signal GS to the gate of the switching transistor T4 of the pixel 12, as described above.

The sensing line control unit 40 provides the sensing control signal SLC to turn on sensing transistors T6 of the pixels 12 of the same horizontal line. An enable time of the sensing control signal SLC may maintain a time for the pixel sensing signal Pxs2 to be sufficiently transferred to the source driver 20 through the sensing line SL.

It may be assumed that the pixel 12 configured according to the embodiment of the disclosure is driven by the driving voltage PVDD having a level of 18V to 24V. The ground voltage PVSS corresponding to the driving voltage PVDD may be assumed to be 0V. Therefore, it may be understood that a sensing range of the pixel sensing signal Pxs2 of the pixel 12, outputted through the sensing line SL, has the level of 18V to 24V.

The source driver 20 is configured to simultaneously provide source signals SO corresponding to data provided from a timing controller (not illustrated), to respective pixels 12 of the same horizontal line of the display panel 10. Also, the source driver 20 is configured to receive pixel sensing signals Pxs2 of the respective pixels 12 of the same horizontal line through sensing lines SL.

In order to output the source signals SO corresponding to the data, the source driver 20 may include components such as a clock data recovery circuit (not illustrated), a latch (not illustrated), a shift register (not illustrated), a gamma circuit (not illustrated), a digital-analog converter (not illustrated), and an output buffer 22. FIG. 1 illustrates that the source driver 20 representatively includes the output buffer 22.

The source driver 20 recovers a clock and data from a transmission signal transmitted in the form of a packet from the timing controller, and the recovery of the clock and the data is performed in the clock data recovery circuit. The latch and the shift register store the recovered data in horizontal line unit and transfer the recovered data to the digital-analog converter. The digital-analog converter selects and outputs a gamma voltage corresponding to the data among gamma voltages provided from the gamma circuit. The output buffer 22 outputs the source signal SO by driving the output signal of the digital-analog converter.

The latch, the shift register, the gamma circuit, the digital-analog converter and the output buffer 22 may be configured to correspond to each pixel 12 of the display panel 10. That is to say, the source driver 20 includes a number of output buffers 22 capable of forming output channels corresponding to respective pixels 12 of the display panel 10.

Further, the source driver 20 includes an analog-digital converter 24, an input signal converter 26, and an input range converter 28 to receive the pixel sensing signal Pxs2.

The analog-digital converter 24 receives a pixel sensing signal Pxs1 within a preset input range, and performs analog-digital conversion on the pixel sensing signal Pxs1. The analog-digital converter 24 receives the pixel sensing signal Pxs1 through the input signal converter 26. For the sake of convenience in explanation, the pixel sensing signal Pxs2 inputted to the input signal converter 26 through the sensing line SL is referred to as a second pixel sensing signal, and the pixel sensing signal Pxs1 inputted to the analog-digital converter 24 after conversion according to the embodiment of the disclosure in the input signal converter 26 is referred to as a first pixel sensing signal.

The analog-digital converter 24 uses a driving voltage VCC and a ground voltage VSS for driving. In the analog-digital converter 24, an input range of the pixel sensing signal Pxs1 may be defined by reference voltages VT and VB which are provided from the input range converter 28. The reference voltage VT has a higher level than the reference voltage VB. Therefore, the input range of the analog-digital converter 24 may be defined between the high level reference voltage VT and the low level reference voltage VB. The driving voltage VCC has a level higher than the reference voltages VT and VB, and the ground voltage VSS has a level lower than the reference voltages VT and VB.

The analog-digital converter 24 has the input range smaller than the sensing range of the second pixel sensing signal Pxs2.

In detail, the analog-digital converter 24 may be described as having an input range of 0.4V to 1.4V. 1.4V may be understood as the level of the reference voltage VT, and 0.4V may be understood as the level of the reference voltage VB. In contrast, the sensing range of the pixel sensing signal Pxs2 of the pixel 12 may be understood as the level of 18V to 24V, as described above. As such, the input range of the analog-digital converter 24 has a range substantially smaller than the sensing range of the pixel sensing signal Pxs2 which is defined as the level of 18V to 24V.

In the case where the analog-digital converter 24 is configured to output a 10-bit data signal, the analog-digital converter 24 divides the first pixel sensing signal Pxs1 between the reference voltages VT and VB into 1024 levels on a decimal number basis, and outputs a data signal corresponding to a level of the first pixel sensing signal Pxs1 by analog-digital conversion.

In other words, the analog-digital converter 24 outputs data having a value of "0" based on the decimal number basis, in correspondence to the first pixel sensing signal Pxs1 of 0.4V, and outputs data having a value of "1023" on the decimal number basis, in correspondence to the first pixel sensing signal Pxs1 of 1.4V.

The pixel sensing signal Pxs2 of the pixel 12, outputted through the sensing line SL, has a signal range smaller than the sensing range.

In the case where the signal range of the second pixel sensing signal Pxs2 falls within the input range of the analog-digital converter 24, the analog-digital converter 24 may perform normal analog-digital conversion on the second pixel sensing signal Pxs2. Namely, the analog-digital converter 24 outputs digital signals having values corresponding to "0" to "1023" on the decimal number basis, for the entire signal range of the second pixel sensing signal Pxs2.

However, in the case where a partial or entire signal range of the second pixel sensing signal Pxs2 is out of the input range of the analog-digital converter 24, it is difficult for the analog-digital converter 24 to perform normal analog-digital conversion on the partial or entire signal range of the second pixel sensing signal Pxs2 which is out of the input range.

In detail, in the case where the second pixel sensing signal Pxs2 has a signal range of 3V to 4V and is inputted to the analog-digital converter 24 as it is, the analog-digital converter 24 outputs a digital signal corresponding to 1.4V being a maximum value of the input range, with respect to the entire signal range of the second pixel sensing signal Pxs2 which is out of the input range. That is to say, the analog-digital converter 24 performs abnormal analog-digital conversion of maintaining a digital signal to have a value corresponding to "1023" on the decimal number basis, for the entire signal range of the second pixel sensing signal Pxs2.

In the case where the second pixel sensing signal Pxs2 is generated in a signal range of 0.4V to 3.4V and is inputted to the analog-digital converter 24 as it is, the analog-digital converter 24 may perform conversion for a partial signal range of the second pixel sensing signal Pxs2 which falls within the input range. However, the analog-digital converter 24 outputs a digital signal corresponding to 1.4V being the maximum value of the input range, with respect to the remaining partial signal range of 1.4V to 3.4V of the second pixel sensing signal Pxs2 which is out of the input range.

In other words, when a part or the entirety of the signal range of the second pixel sensing signal Pxs2 is out of the input range of the analog-digital converter 24, the signal range of the second pixel sensing signal Pxs2 needs to be converted to perform normal analog-digital conversion. The signal range of the second pixel sensing signal Pxs2 needs to be shifted or be changed in scale to fall within the input range of the analog-digital converter 24. The source driver 20 configured according to the embodiment of the disclosure includes the input signal converter 26 to convert the signal range of the second pixel sensing signal Pxs2.

Namely, the input signal converter 26 has the function of converting the signal range of the second pixel sensing signal Pxs2 of the pixel 12 of the display panel 10 to fall within the input range of the analog-digital converter 24.

To this end, the input signal converter 26 is configured to receive the second pixel sensing signal Pxs2 from the pixel 12 of the display panel 10, convert the signal range of the second pixel sensing signal Pxs2 by a control signal RCS in the case where the second pixel sensing signal Pxs2 is out of the input range of the analog-digital converter 24, and output the first pixel sensing signal Pxs1 having a signal range which falls within the input range of the analog-digital converter 24, to the analog-digital converter 24.

Figure 2:
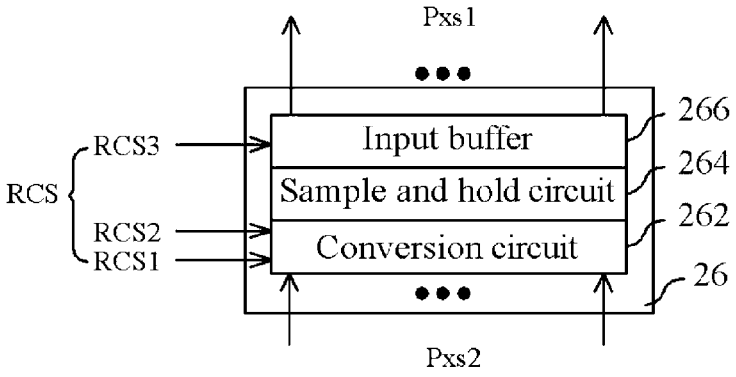
FIG. 2 is a detailed block diagram illustrating a representation of an example of an input signal converter illustrated FIG. 1.

For instance, the input signal converter 26 may be configured as illustrated in FIG. 2.

Referring to FIG. 2, the input signal converter 26 may include a conversion circuit 262, a sample and hold circuit 264, and an input buffer 266. The conversion circuit 262, the sample and hold circuit 264 and the input buffer 266 contribute to input signal conversion individually or in combination.

The conversion circuit 262 may be configured by a circuit which reads out the second pixel sensing signal Pxs2, and may include a circuit for an additional function for the input buffer 266 and the sample and hold circuit 264. The sample and hold circuit 264 samples and holds the second pixel sensing signal Pxs2 which is inputted to the conversion circuit 262. The input buffer 266 is configured by a buffer circuit which converts the second pixel sensing signal Pxs2 held in the sample and hold circuit 264 into the first pixel sensing signal Pxs1 and outputs the first pixel sensing signal Pxs1.

In correspondence to the above-described configuration of the input signal converter 26, the control signal RCS may be understood as an option signal which is provided by being generated inside or outside the source driver 20, and may have a value corresponding to the signal range of the second pixel sensing signal Pxs2.

For instance, the control signal RCS may have a value for shifting the signal range of the second pixel sensing signal Pxs2 or adjusting a scale of the signal range of the second pixel sensing signal Pxs2 to fall within the input range of the analog-digital converter 24. Also, the control signal RCS may have a value for adjusting a gain of the input buffer 266, to allow a signal range of the first pixel sensing signal Pxs1 to fall within the input range of the analog-digital converter 24. The control signal RCS may be provided as a composite signal for performing at least two in combination among the shift of the signal range of the second pixel sensing signal Pxs2, the adjustment of the scale of the signal range of the second pixel sensing signal Pxs2, and the adjustment of the gain of the input buffer 266.

In FIG. 2, the control signal RCS may include first to third control signals RCS1 to RCS3, and may be provided to include at least one of the first to third control signals RCS1 to RCS3 depending on a manufacturer's intention.

The first control signal RCS1 has a value for shifting the signal range of the second pixel sensing signal Pxs2, and is provided to the conversion circuit 262. The second control signal RCS2 has a value for adjusting the scale of the signal range of the second pixel sensing signal Pxs2, and is provided to the conversion circuit 262. The third control signal RCS3 has a value for adjusting the gain of each buffer included in the input buffer 266 which outputs the first pixel sensing signal Pxs1, and is provided to each buffer of the input buffer 266.

Figure 3:
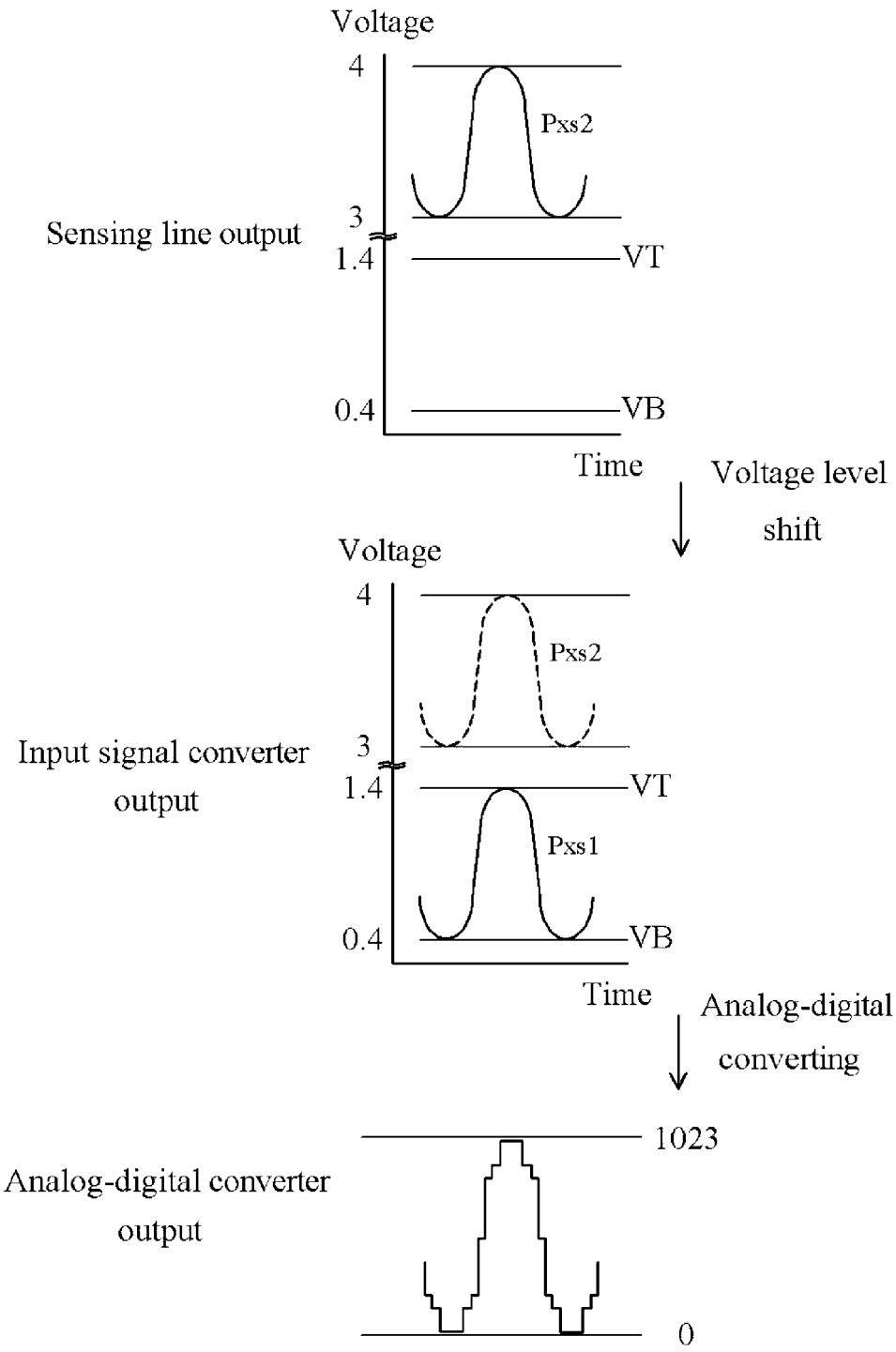
FIG. 3 is a representation of an example of a waveform diagram to assist in the explanation of a signal processing procedure in the driver as a signal range of a pixel sensing signal is shifted.

First, as illustrated in FIG. 3, the conversion circuit 262 of the input signal converter 26 may shift the signal range of the second pixel sensing signal Pxs2 by the first control signal RCS1, thereby converting the signal range of the second pixel sensing signal Pxs2 to fall within the input range of the analog-digital converter 24.

The first control signal RCS1 has a value corresponding to the signal range of the second pixel sensing signal Pxs2.

In detail, the first control signal RCS1 may correspond to at least one of a medium voltage, a peak voltage and a valley voltage of the signal range of the second pixel sensing signal Pxs2. The peak voltage means a voltage having a highest level in the signal range, the valley voltage means a voltage having a lowest level in the signal range, and the medium voltage means a voltage having a medium level between the peak voltage and the valley voltage. The first control signal RCS1 may be the valley voltage of the signal range of the second pixel sensing signal Pxs2.

In detail, it is assumed that the second pixel sensing signal Pxs2 is outputted from the sensing line SL, is inputted to the conversion circuit 262 of the input signal converter 26 and has a signal range of 3V to 4V. In this case, the peak voltage of the second pixel sensing signal Pxs2 is 4V, the medium voltage thereof is 3.5V, and the valley voltage thereof is 3V. Therefore, the first control signal RCS1 may be set to 3V being the valley voltage of the signal range of the second pixel sensing signal Pxs2.

The input range of the analog-digital converter 24 may be defined as 0.4V to 1.4V. Thus, the signal range of the second pixel sensing signal Pxs2 outputted from the sensing line SL is formed to be about 2.6V higher than the input range of the analog-digital converter 24.

The conversion circuit 262 receives the first control signal RCS1 of 3V in correspondence to the second pixel sensing signal Pxs2, and shifts the signal range of the second pixel sensing signal Pxs2 by the first control signal RCS1 of 3V to have a valley voltage of 0.4V. That is to say, the conversion circuit 262 shifts the valley voltage of the second pixel sensing signal Pxs2 from 3V to 0.4V. Hence, the conversion circuit 262 provides the second pixel sensing signal Pxs2 having the signal range converted to a signal range of 0.4V to 1.4V, to the sample and hold circuit 264. As a result, the input buffer 266 may output the first pixel sensing signal Pxs1 having a signal range that falls within the input range of the analog-digital converter 24.

Consequently, the analog-digital converter 24 may perform normal analog-digital conversion on the first pixel sensing signal Pxs1 having the signal range falling within the input range thereof, and thereby, may output a data signal corresponding to "0" to "1023" on the decimal number basis.

Figure 4:
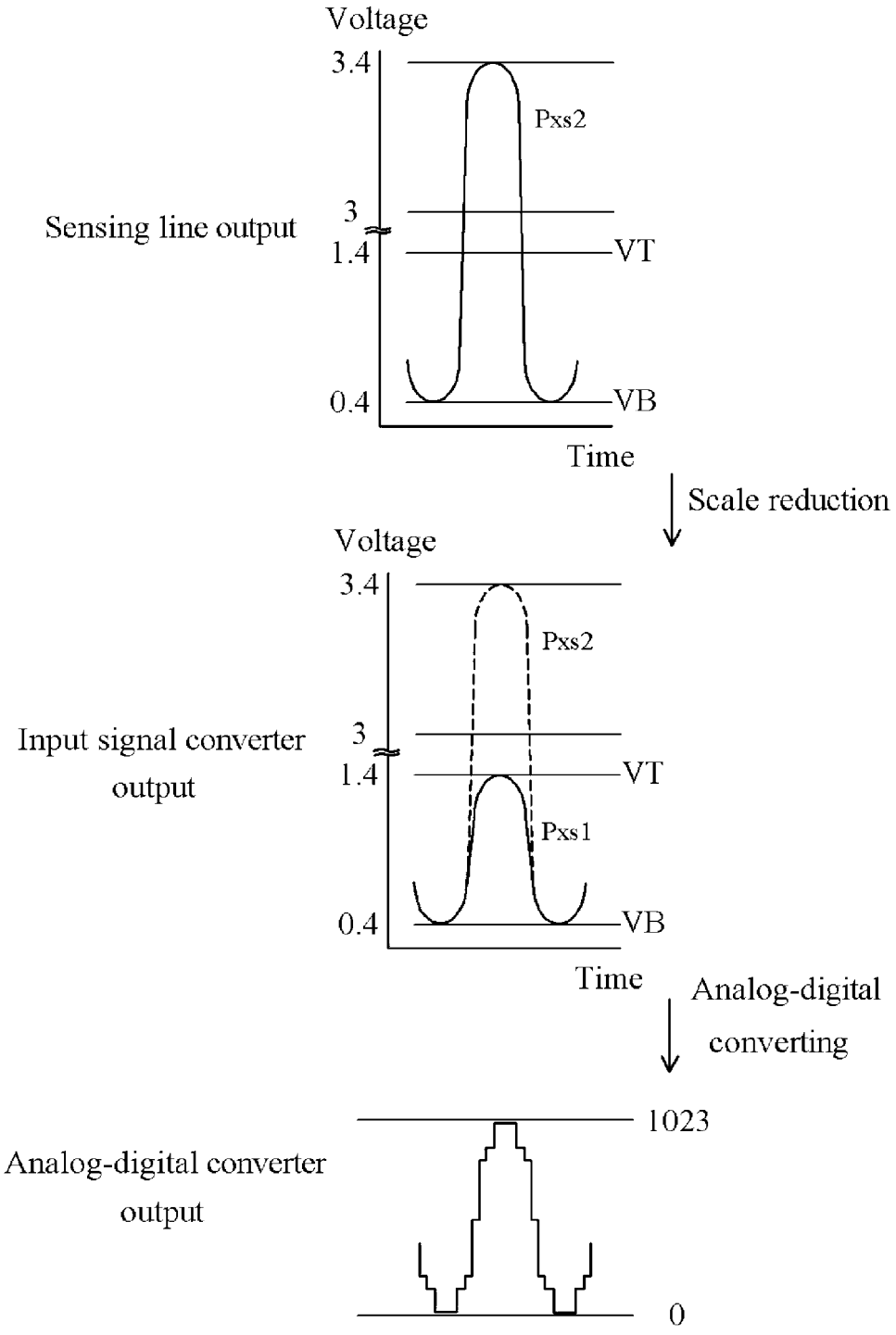
FIG. 4 is a representation of an example of a waveform diagram to assist in the explanation of a signal processing procedure in the driver as a scale of a signal range of a pixel sensing signal is reduced.

As illustrated in FIG. 4, the conversion circuit 262 of the input signal converter 26 may reduce the scale of the signal range of the second pixel sensing signal Pxs2 by the second control signal RCS2, thereby converting the signal range of the second pixel sensing signal Pxs2 to fall within the input range of the analog-digital converter 24.

The second control signal RCS2 has a value corresponding to the scale of the signal range of the second pixel sensing signal Pxs2. In other words, the second control signal RCS2 may be set to have a voltage corresponding to an amplitude of the signal range of the second pixel sensing signal Pxs2.

In detail, it is assumed that the second pixel sensing signal Pxs2 is outputted from the sensing line SL, is inputted to the conversion circuit 262 of the input signal converter 26 and has a signal range of 0.4V to 3.4V. Namely, the signal range of the second pixel sensing signal Pxs2 forms a scale with an amplitude of 3V. Therefore, the second control signal RCS2 may be set to 3V being the amplitude of the signal range of the second pixel sensing signal Pxs2.

The input range of the analog-digital converter 24 may be defined as 0.4V to 1.4V. Thus, the second pixel sensing signal Pxs2 outputted from the sensing line SL has the signal range whose amplitude is three times larger than the input range of the analog-digital converter 24.

The conversion circuit 262 converts the signal range of the second pixel sensing signal Pxs2 such that a ratio between an input scale and an output scale is inversely proportional to the level of the second control signal RCS2. For instance, the conversion circuit 262 outputs the second pixel sensing signal Pxs2 in a signal range having the same scale as that inputted, in the case where the second control signal RCS2 is 1V, and outputs the second pixel sensing signal Pxs2 in a signal range of a scale reduced to ½ in comparison with that inputted, in the case where the second control signal RCS2 is 2V. In this case, the scale conversion of the signal range may be understood as the peak voltage of the second pixel sensing signal Pxs2 is lowered with respect to the valley voltage.

The conversion circuit 262 according to the embodiment receives the second control signal RCS2 of 3V. Therefore, the conversion circuit 262 converts the signal range of the second pixel sensing signal Pxs2 to have an output scale that is reduced to ⅓ in comparison with an input scale. Thus, the conversion circuit 262 provides the second pixel sensing signal Pxs2 having a signal range that falls within the input range of the analog-digital converter 24, to the sample and hold circuit 264. As a result, the input buffer 266 may output the first pixel sensing signal Pxs1 having a signal range that falls within the input range of the analog-digital converter 24.

Consequently, the analog-digital converter 24 may perform analog-digital conversion on the first pixel sensing signal Pxs1 which falls within the input range thereof, and thereby, may output a data signal corresponding to "0" to "1023" on the decimal number basis.

The input buffer 266 of the input signal converter 26 may adjust the scale of the signal range of the second pixel sensing signal Pxs2 by adjusting gains of buffers included therein by the third control signal RCS3. If a gain of a buffer is adjusted, a scale of an output signal is changed. That is to say, if a gain increases, an amplification degree of a buffer increases to increase a scale of an output signal, and if a gain decreases, an amplification degree of a buffer decreases to decrease a scale of an output signal.

As a result, the input buffer 266 outputs the second pixel sensing signal Pxs2 held in the sample and hold circuit 264 as the first pixel sensing signal Pxs1 by using the buffers whose gains are controlled by the third control signal RCS3. The scale of the signal range of the first pixel sensing signal Pxs1 is changed by a change in amplification degree in correspondence to the third control signal RCS3 as compared to the second pixel sensing signal Pxs2. In other words, the input buffer 266 outputs the first pixel sensing signal Pxs1 having the signal range that falls within the input range of the analog-digital converter 24, by the third control signal RCS3.

The input signal converter 26 according to the embodiment of the disclosure may be configured to perform in combination the shift of the signal range of the second pixel sensing signal Pxs2 and the reduction of the scale of the second pixel sensing signal Pxs2 by using the control signal RCS in which the first to third control signals RCS1 to RCS3 are combined.

In this case, the input signal converter 26 may be configured to simultaneously or sequentially perform first to third conversions corresponding to the first to third control signals RCS1 to RCS3. The first conversion may be defined as shifting the signal range of the second pixel sensing signal Pxs2, the second conversion may be defined as reducing the scale of the signal range of the second pixel sensing signal Pxs2, and the third conversion may be defined as converting the scale of the signal range of the second pixel sensing signal Pxs2 through adjustment of the gains of the buffers.

In detail, the conversion circuit 262 performs the first conversion of shifting the signal range of the second pixel sensing signal Pxs2 by the first control signal RCS1, and performs the second conversion of reducing the scale of the signal range of the second pixel sensing signal Pxs2 by the second control signal RCS2. The input buffer 266 changes the scale of the signal range of the second pixel sensing signal Pxs2 depending on the gains of the buffers therein that are adjusted by the third control signal RCS3.

In detail, the operation of the embodiment in the case where the first and second control signals RCS1 and RCS2 are combined in the control signal RCS will be described below.

It is assumed that the second pixel sensing signal Pxs2 has a signal range of 1.4V to 3.4V. In order for the conversion of the signal range of the second pixel sensing signal Pxs2, the first control signal RCS1 is set to 1.4V being a valley voltage of the signal range of the second pixel sensing signal Pxs2, and the second control signal RCS2 is set to 2V corresponding to an amplitude of the signal range of the second pixel sensing signal Pxs2.

The conversion circuit 262 performs the first conversion of shifting the valley voltage of the signal range of the second pixel sensing signal Pxs2 to 0.4V by the first control signal RCS1 of 1.4V. By the first conversion, the second pixel sensing signal Pxs2 has the signal range that is shifted to a signal range of 0.4V to 2.4V. Then, the conversion circuit 262 performs the second conversion of reducing an amplitude of the signal range of the second pixel sensing signal Pxs2 to ½ by the second control signal RCS2 of 2V. As a result, the conversion circuit 262 may provide the second pixel sensing signal Pxs2 which falls within the input range of the analog-digital converter 24, to the sample and hold circuit 264.

As described above, the input signal converter 26 may convert the second pixel sensing signal Pxs2 to have a signal range whose level and scale fall within the input range of the analog-digital converter 24.

On the other hand, the input range converter 28 has a function of compensating for a change in the input range of the analog-digital converter 24 by a process deviation. A gain may be corrected through adjustment of the input range, and the gain correction may be optionally adjusted by a user.

To this end, the input range converter 28 may be configured to provide the reference voltages VT and VB to the analog-digital converter 24 and convert the input range of the analog-digital converter 24 by changing at least one of the reference voltages VT and VB in response to a control signal RVS for compensating for an input deviation of the analog-digital converter 24.

The input range converter 28 may include a register 100 and a variable reference voltage generator 102.

The register 100 may store compensation information corresponding to a deviation of the input range of the analog-digital converter 24, and may provide the control signal RVS corresponding to the compensation information.

The variable reference voltage generator 102 may provide the reference voltages VT and VB having levels in which a deviation is compensated for in response to the control signal RVS, to the analog-digital converter 24.

The register 100 may include, as the compensation information, first information for compensating for a deviation of the reference voltages VT and VB due to a gain and an offset of the variable reference voltage generator 102, second information for compensating for a deviation of the reference voltages VT and VB due to a gain and an offset of the analog-digital converter 24, and third information in which the first information and the second information are combined.

By the above-described configuration of the embodiment, in the case where the input range of the analog-digital converter 24 is changed, the control signal RVS based on the compensation information corresponding to a cause of the change is provided to the variable reference voltage generator 102. The variable reference voltage generator 102 may compensate for the input range of the analog-digital converter 24 which is changed by a process deviation, by compensating for at least one of the reference voltages VT and VB depending on the control signal RVS.

As is apparent from the above descriptions, according to the embodiments of the disclosure, a signal range of a pixel sensing signal may be converted to fall within an input range of the analog-digital converter 24, or the input range of the analog-digital converter 24 that is changed by a process deviation may be compensated for.

Therefore, the analog-digital converter 24 of the source driver 20 may perform analog-digital conversion by normally recognizing a pixel sensing signal generated under the environment of a driving voltage different from its own driving voltage.

Also, the analog-digital converter 24 of the source driver 20 may receive a pixel sensing signal while maintaining a normal input range, and may accurately perform analog-digital conversion.

Further, since a change in the input range of the analog-digital converter 24 caused by a process deviation may be simply compensated for, the yield of the source driver 20 may be improved.

Moreover, in the driving of a display device, a block dim phenomenon by a deviation between source driver chips may be eliminated

The invention claimed is:

1. A driver of a display device, comprising:

an analog-digital converter configured to receive a first pixel sensing signal within a preset input range, and perform analog-digital conversion on the first pixel sensing signal; and an input signal converter configured to receive a second pixel sensing signal from a pixel of a display panel, convert the second pixel sensing signal by using a control signal such that a signal range of the second pixel sensing signal falls within the input range, and output the first pixel sensing signal obtained as the second pixel sensing signal is converted, to the analog-digital converter, wherein the input signal converter comprises:

a conversion circuit configured to receive the second pixel sensing signal; and an input buffer configured to output the first pixel sensing signal obtained as the second pixel sensing signal is converted, and wherein the first pixel sensing signal corresponds to the second pixel sensing signal which is converted by at least one of the conversion circuit and the input buffer.

2. The driver of a display device according to claim 1, wherein the input signal converter converts the second pixel sensing signal by shifting the signal range depending on a level of the control signal.

3. The driver of a display device according to claim 2, wherein the control signal corresponds to one among a medium voltage, a peak voltage and a valley voltage of the signal range.

4. The driver of a display device according to claim 1, wherein the input signal converter converts the second pixel sensing signal by reducing a scale of the signal range depending on a level of the control signal, and wherein the control signal has a value corresponding to an amplitude of the signal range.

5. The driver of a display device according to claim 1, wherein the input signal converter includes the input buffer, and converts a scale of the signal range by adjusting a gain of the input buffer by using the control signal.

6. The driver of a display device according to claim 1, wherein the conversion circuit performs a first conversion of shifting the signal range of the second pixel sensing signal in response to a first control signal, and a second conversion of reducing a scale of the signal range of the second pixel sensing signal in response to a second control signal, wherein the input buffer converts a scale of the signal range of the second pixel sensing signal by adjusting a gain of the input buffer in response to a third control signal, and wherein the input signal converter receives, as the control signal, at least two among the first control signal corresponding to one of a medium voltage, a peak voltage and a valley voltage of the signal range of the second pixel sensing signal, the second control signal corresponding to an amplitude of the signal range of the second pixel sensing signal and the third control signal for adjusting a gain of the input buffer.

7. A driver of a display device, comprising:

an analog-digital converter configured to receive a pixel sensing signal within an input range that is defined by a first reference voltage and a second reference voltage, and perform analog-digital conversion on the pixel sensing signal; and an input range converter configured to provide the first reference voltage and the second reference voltage to the analog-digital converter, and convert the input range by changing at least one of the first reference voltage and the second reference voltage in response to a control signal for compensating for a deviation of the input range, wherein the input range converter comprises:

a register configured to store compensation information corresponding to the deviation of the input range, and provide the control signal corresponding to the compensation information, and a variable reference voltage generator configured to provide the first reference voltage and the second reference voltage having levels between which the deviation is compensated for in response to the control signal, to the analog-digital converter.

8. The driver of a display device according to claim 7, wherein the register includes, as the compensation information, at least one among first information for compensating for the deviation of the first reference voltage and the second reference voltage by a gain and an offset of the variable reference voltage generator, second information for compensating for the deviation of the first reference voltage and the second reference voltage by a gain and an offset of the analog-digital converter, and third information in which the first information and the second information are combined.

9. A driver of a display device, comprising:

an analog-digital converter configured to receive a first pixel sensing signal within an input range that is defined by a first reference voltage and a second reference voltage, and perform analog-digital conversion on the first pixel sensing signal;

an input signal converter configured to receive a second pixel sensing signal from a pixel of a display panel, convert the second pixel sensing signal by using a control signal such that a signal range of the second pixel sensing signal falls within the input range, and output the first pixel sensing signal obtained as the second pixel sensing signal is converted, to the analog-digital converter; and an input range converter configured to provide the first reference voltage and the second reference voltage, and convert the input range by changing at least one of the first reference voltage and the second reference voltage in response to a second control signal for compensating for a deviation of the input range, wherein the analog-digital converter receives the second pixel sensing signal whose signal range is converted, within the input range whose deviation is compensated for by the second control signal, wherein the input signal converter comprises:

a conversion circuit configured to receive the second pixel sensing signal; and an input buffer configured to output the first pixel sensing signal obtained as the second pixel sensing signal is converted, and wherein the first pixel sensing signal corresponds to the second pixel sensing signal which is converted by at least one of the conversion circuit and the input buffer in response to the control signal.

10. The driver of a display device according to claim 9, wherein the conversion circuit performs a first conversion of shifting the signal range of the second pixel sensing signal in response to a first control signal, and a second conversion of reducing a scale of the signal range of the second pixel sensing signal in response to a second control signal, wherein the input buffer performs a third conversion of converting a scale of the signal range of the second pixel sensing signal by adjusting a gain of a buffer therein in response to a third control signal, and wherein the input signal converter receives, as the control signal, at least two among the first control signal corresponding to one of a medium voltage, a peak voltage and a valley voltage of the signal range, the second control signal corresponding to an amplitude of the signal range of the second pixel sensing signal and the third control signal for adjusting a gain of the input buffer.

* * * * *